United States Patent [19]

Mori

[11] Patent Number: 4,922,738

[45] **Date of Patent: * May 8, 1990**

[54] PROCESS FOR MANUFACTURING A SINGLE PIECE ALLOY WHEEL RIM FOR VEHICLE TIRES

[76] Inventor: Hiroshi Mori, 2751 Aqua Verde Cir., Los Angeles, Calif. 90077

[ * ] Notice: The portion of the term of this patent subsequent to Sep. 15, 2004 has been disclaimed.

[21] Appl. No.: 97,288

[22] Filed: Sep. 11, 1987

Related U.S. Application Data

[63] Continuation-in-part of Ser. No. 721,172, Apr. 8, 1985, Pat. No. 4,693,104.

[51] Int. Cl.[5] ..... B21H 1/10

[52] U.S. Cl. ..... 72/68; 72/354

[58] Field of Search ..... 29/159.1; 72/68, 354, 72/358, 341

[56] References Cited

U.S. PATENT DOCUMENTS

| | | | |
|---|---|---|---|
| 2,633,765 | 4/1953 | Glasner | 72/354 |
| 3,443,411 | 5/1969 | Anthony | 72/257 |
| 4,693,104 | 9/1987 | Mori | 72/68 |

FOREIGN PATENT DOCUMENTS

| | | | |
|---|---|---|---|
| 8133 | 3/1972 | Japan | 72/354 |
| 10385 | 1/1980 | Japan | 29/159.1 |
| 718076 | 11/1954 | United Kingdom | 72/354 |

*Primary Examiner*—Lowell A. Larson
*Attorney, Agent, or Firm*—Lyon & Lyon

[57] ABSTRACT

A process for forming a single piece rim for vehicle tires comprising the steps of axially deforming a toroid of aluminum alloy material so as to form a hollow tubular element of predetermined length and thickness having an annular inwardly directed radial flange intermediary of the ends thereof and spaced predetermined distances from the element ends and spin forming the ends of the element outwardly and axially to shape the inner and outer rim and define an inner rim flange and an outer rim flange.

5 Claims, 3 Drawing Sheets

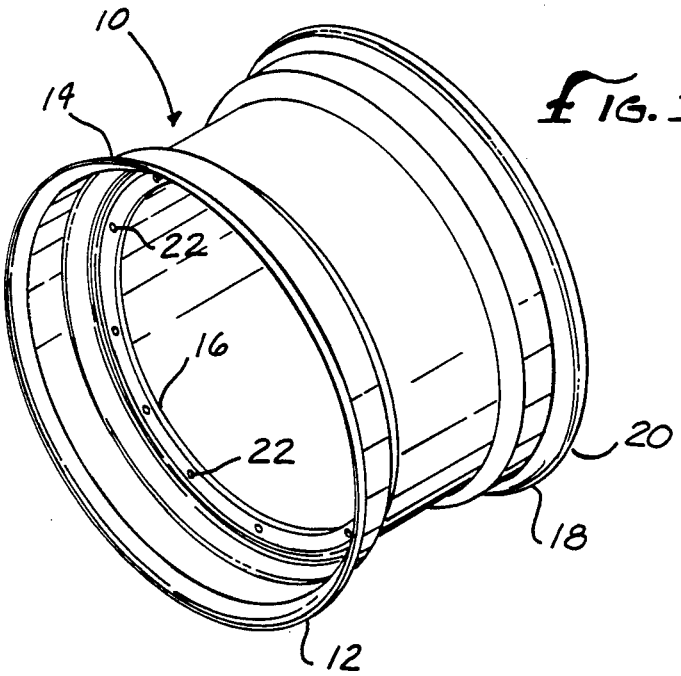
FIG. 1.
FIG. 2.
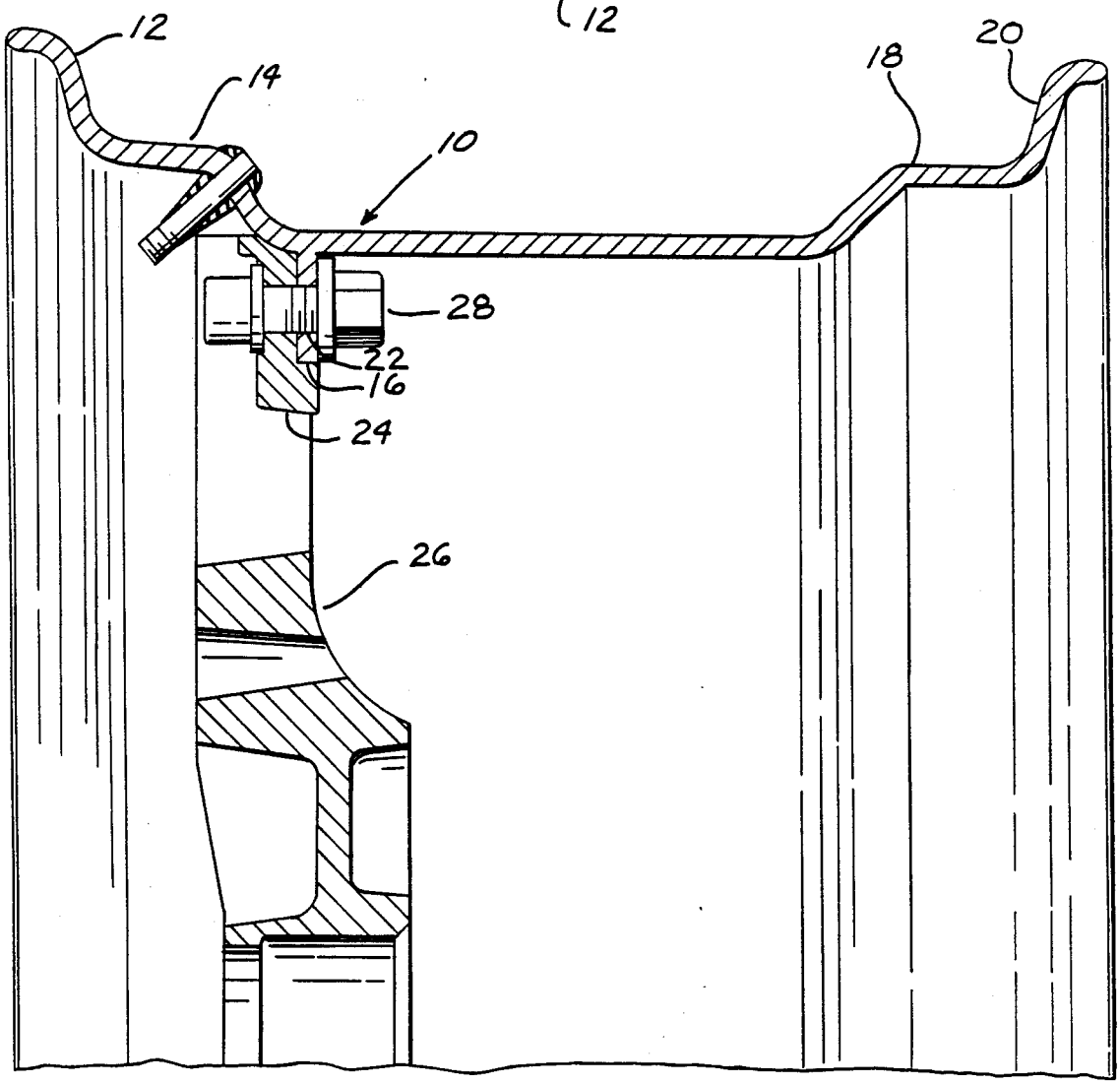

PROCESS FOR MANUFACTURING A SINGLE PIECE ALLOY WHEEL RIM FOR VEHICLE TIRES

This is a continuation-in-part of pending application, Ser. No. 721,172, filed Apr. 8, 1985 and entitled "Manufacturing a Single Piece Aluminum Alloy Wheel Rim for Vehicle Tires", now U.S. Pat. No. 4,693,104 granted Sept. 15, 1987.

BACKGROUND OF THE INVENTION

The present invention relates to a method of manufacturing a single piece aluminum alloy wheel rim for vehicle tires. Vehicle wheels constructed of aluminum alloys are quite popular due to their aesthetic appearance and light weight. Because aluminum alloys are not readily susceptible to welding due to the deleterious effect of the welding process on the strength of the metal, it has been standard practice to manufacture separately the disc or wheel center and the inner and outer rims and subsequently to assemble the component parts by a suitable fastening means such as a plurality of threaded bolts. Such wheels are commonly referred to as three-piece wheels.

Three-piece wheels generally comprise superposed radial directed flanges extending from the inner and outer rims which are secured to a peripheral mounting on the wheel center by the fastening means. The problems inherent in such structures are inadequate strength and leakage. Inadequate strength, in addition to the obvious safety problems, has prevented such wheels from employing a desirable positive wheel offset which is highly advantageous, particularly for front wheel drive vehicles, to provide a greater area for larger breaking drums for improved breaking performance while complying with existing wheel placement regulations. In an effort to solve these problems, numerous different three-piece wheel configurations have been developed. For example, U.S. Pat. No. 4,466,670 teaches a configuration which provides improved strength characteristics over previously developed three-piece wheels and employs a silicon seal to prevent leakage. Applicant's co-pending application Ser. No. 721,172 employs a rim design which provides sufficient strength to maximize the positive wheel offset. Nevertheless, regardless of the design, the necessity to manufacture and subsequently secure together the inner and outer rims necessarily increases the cost of manufacture. It would therefore be highly desirable to develop a method of manufacturing a single piece aluminum alloy rim for use with conventional alloy wheel centers which would reduce assembly time and the cost of manufacture while maximizing strength. Because such a rim requires a radial flange or base for its securement to the wheel center and aluminum alloys cannot be readily welded without weakening the resultant rim, such wheels have not been heretofore available. The method of manufacture disclosed herein provides such a single piece flanged rim.

SUMMARY OF THE INVENTION

Briefly, the present invention comprises the application of high pressure to a pair of oppositely disposed dies which press against a solid toroid of the material of which the wheel is to be constructed to form a tube of a predetermined given length having a radially extending inner annular flange disposed intermediary of the ends thereof at a predetermined location. The ends of the tube are subsequently subjected to a sheet metal spinning process forming the inner and outer rim flanges and the desired contour of the wheel rim.

It is the principal object of the present invention to provide a method of manufacturing a single piece wheel rim for vehicle tires constructed of an aluminum alloy material and having a radially directed base integrally formed thereon for securement to a conventional alloy wheel center.

It is another object of the present invention to provide a method of manufacturing a single piece wheel rim for vehicle tires which allows for the placement of the radial directed base at any desired location along the rim to obtain any desired wheel offset without adversely affecting the strength of the wheel.

These and other objects and advantages of the present invention will become readily apparent from the following detailed description taken in conjunction with the accompanying drawings.

BRIEF DESCRIPTION OF THE DRAWINGS

FIG. 1 is a perspective view of a wheel rim constructed in accordance with the present invention.

FIG. 2 is a sectional view of a wheel rim constructed in accordance with the present invention showing the rim secured to a wheel center.

DESCRIPTION OF THE PREFERRED EMBODIMENT

Figure 3:
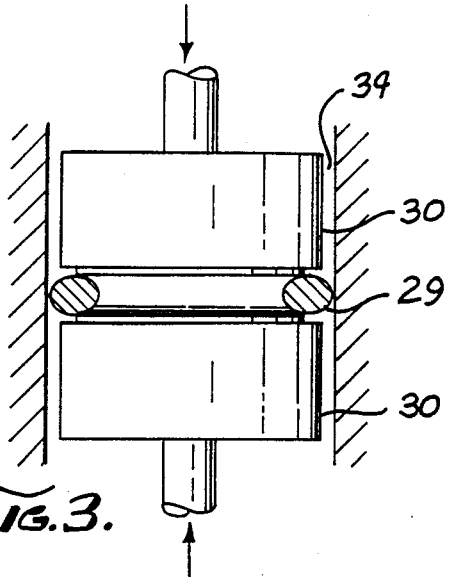
FIGS. 3 and 4 are schematic representations of the forming of the toroid by pressing dies into a tube having an inwardly directed radial flange.

The single piece alloy rim 10 of the present invention is illustrated in FIGS. 1 and 2. As seen therein the rim comprises an outer rim flange 12, outer rim portion 14, a radially directed flange or base 16, inner rim portion 18 and an inner rim flange 20. The outer and inner rim flanges 12 and 20 cooperate to accommodate a vehicle tire in the conventional manner. The radially directed flange 16 is provided with a plurality of spaced apertures 22 extending therethrough for securement to the ring mount 24 on a conventional alloy wheel center 26 by a corresponding plurality of threaded fastening members 28.

Figure 4:
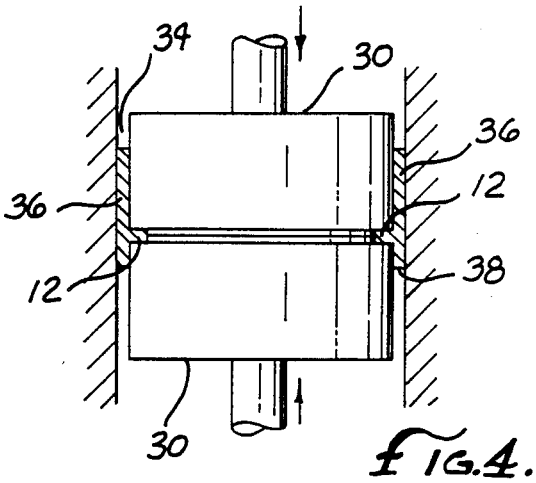
Figure 5:
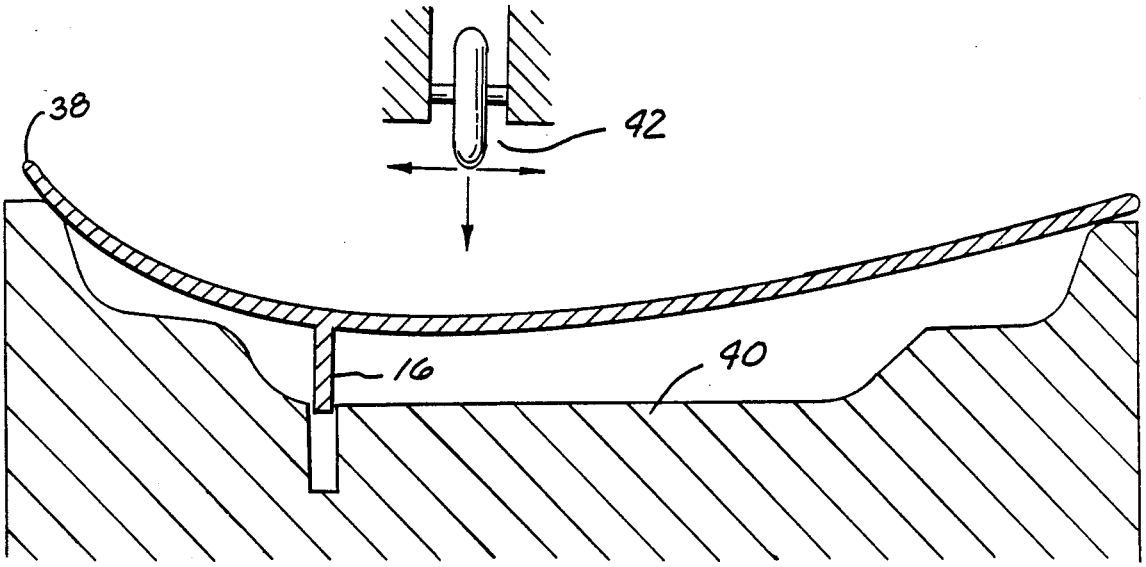
FIG. 5 is a schematic representation of the sheet metal spinning of the formed tube into the desired rim curvatures and to impart the rim flanges to the extended ends thereof.

The process for manufacturing the rim 10 is illustrated in FIGS. 3–5. As seen therein, toroid 29 of the material of which the wheel is to be fabricated, is placed between a pair of high pressure double press dies 30 in a cavity 34. The dies are moved inwardly under high pressure of about 12,000 tons causing the metal to flow about and between the dies as seen in FIG. 5 to form the toroid 29 of material into a tube configuration 36 having an integrally formed inwardly directed radial flange 16. By varying the axial pressure and movement of the dies 30 in relation to the size of toroid 29 and the desired thickness of the resultant tube 36, the length of the tube 36 and desired disposition of the radial flange 16 with respect to the ends of the tube can be achieved. If necessary or desired, the tube can be further sized by severing the ends of the tube 36 so as to provide the tube with the desired length for the particular rim to be manufactured while spacing the radial flange 16 the desired distance from the tube ends. The spacing of the formed radial flange 16 from outer end 38 of the tube determines the desired amount of wheel offset as will become apparent.

By way of example, a six pound toroid of aluminum alloy material having an outside diameter of about six inches and an inside diameter of about four inches could be used in the aforesaid process to form a tube 36 of about eight inches in length, having a wall thickness of about 5 mm.

The formed tube 36 is next subjected to a conventional sheet metal spinning process employing a spinning die 40 and movable roller 42 illustrated in FIG. 5 to impart the desired curvature to the outer and inner rim portions 14 and 18 of the finished rim 10 and to impart to the extended ends of the rim the outer and inner rim flanges 12 and 20. The rim mounting apertures 22 are then drilled through the radial flange 16 to accommodate the threaded fastening members 28 for subsequent securement of the rim 10 to the wheel center 26. A single aperture 44 is also drilled through formed outer rim portions 14 to accommodate a tire valve stem 46. Finally, the rim is polished as desired.

Figure 6:
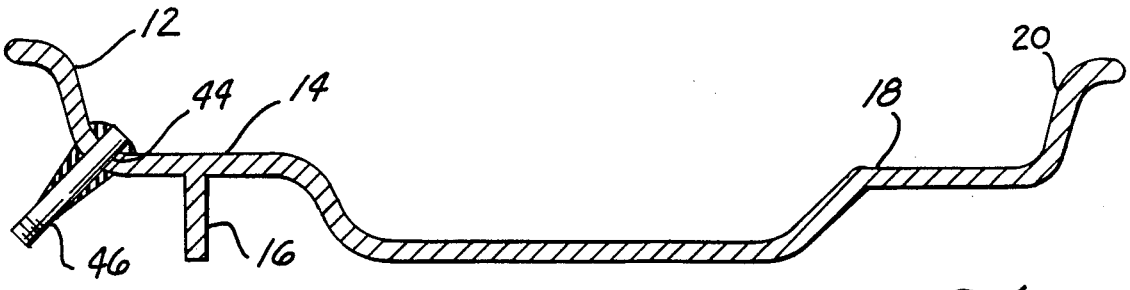
FIG. 6 is a sectional view of a wheel rim constructed in accordance with the present invention having an increased positive wheel offset.

By varying the deformation of toroid 29 by the application of different pressures on dies 30, the radial flange 16 can be formed closer to the outer rim flange 12 to provide for increased positive wheel offset. Due to the inherent strength in the single piece rim formed by the aforesaid process, so positioning the radial flange 16 does not adversely affect the strength of the rim or the resultant wheel. To provide such an offset it is necessary originally to form the tube 36 with a larger diameter to accommodate the necessary inward bending during the spinning process in the shaping of the inner and outer rim portions to provide a rim of the type illustrated in FIG. 6 with the same transverse dimension as that shown in FIG. 2. It should also be noted that tube 36 could be made thicker during the forming process so that the resultant rim could accommodate a plurality of spokes for the forming of a wire wheel.

Figure 7:
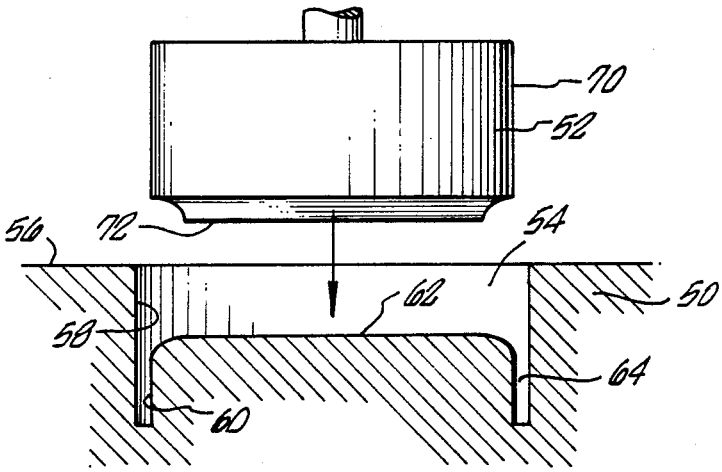
FIGS. 7–9 are schematic representations of an alternate embodiment of a portion of the process of the present invention wherein the toroid is pressed into a tube having an inwardly directed radial flange.
Figure 8:
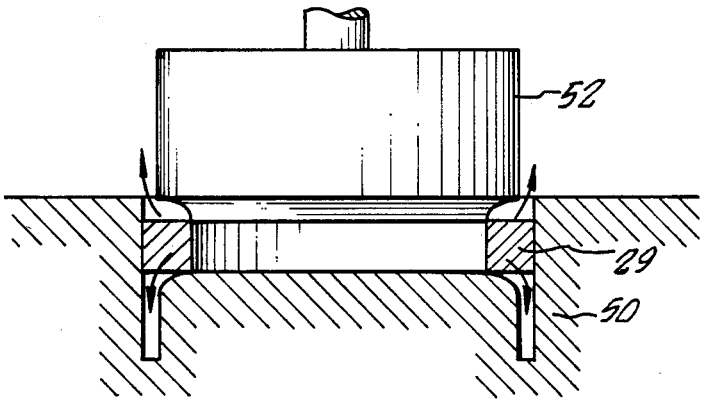
Figure 9:
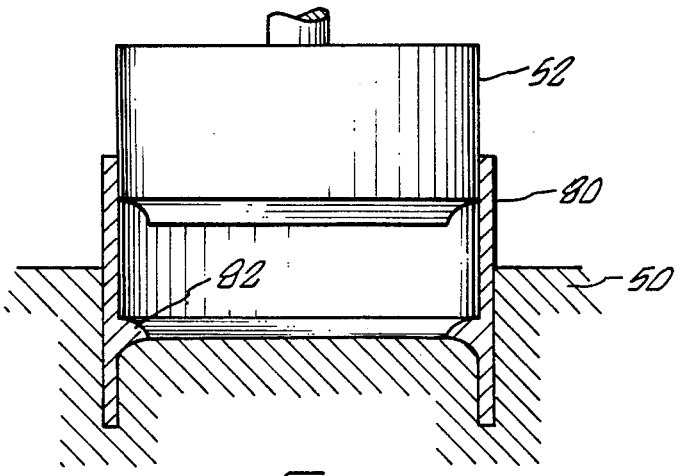

An alternate embodiment of the portion of the process wherein the toroid 29 of alloy material is formed into tube 36 is illustrated in FIG. 7–9. In this embodiment, toroid 29 is disposed over stationary die 50 and only press die 52 is moveable. Stationary die 50 has a recessed cavity 54 in the upper surface 56 thereof defined by an outer extended vertical cylindrical wall portion 58, inner cylindrical vertical wall portion 60, and a horizontal circular surface 62. The inner wall portion 60 is spaced from the outer wall portion 58 to define an annular channel 65 extending downwardly from and about surface 62. The juncture 66 of the inner vertical wall portion 60 and horizontal surface 62 is rounded to facilitate material flow into channel 64 upon deformation of the toroid 29 under pressure from press die 52 as will be described.

Moveable press die 52 is of a cylindrical configuration and defines an outer vertical cylindrical wall 70 disposed in vertical alignment with the inner wall portion 60 of the stationary die 50. Press die 52 also defines a horizontal lower surface 72 disposed above and parallel to surface 62 on the stationary die 50. Arcuate recess 74 extends radially about surface 72 between said surface and the outer cylindrical wall 70 of the moveable press die 52.

As seen in FIGS. 8 and 9, the toroid 29 of the material of which the wheel is to be fabricated is placed in the recessed cavity 54 in the stationary die 50 and the moveable die 52 is pressed inwardly against the toroid under high pressure of about 12,000 tons. As die 50 presses against the toroid, the toroid is deformed and metal flows downwardly into the annular channel 64, upwardly about and adjacent the cylindrical wall 70 of the moveable die 52, and into the area between press dies 50 and 52 defined by the arcuate recess 74 in die 52 and the curved juncture 66 of the inner vertical wall portion 50 and horizontal surface 52 of the stationary die 50. Press die 52 is then raised as seen in FIG. 9, leaving a formed tube configuration 80 having an integrally formed inwardly directed flange 82. The formed flange 82 has curved upper and lower surfaces due to the configuration of arcuate recess 74 and juncture 66 in dies 52 and 50 respectively. Accordingly, it has been necessary to machine flange 82 to provide the desired configuration of flange 16 and seen in FIG. 5 wherein the parallel surfaces of the flange are perpendicularly disposed with respect to the longitudinal axis of the formed tube.

With the formation of tube 80 and the machining flange 82, the remainder of the process is the same as in the prior embodiment. Tube 80 is then subjected to the same metal spinning process as tube 36 in the prior embodiment, shown in FIG. 5, to provide the desired curvature to the outer and inner rim portions of the finished rim and to impart to the extended ends of the rim the outer and inner rim flanges.

Various changes and modifications may be made in carrying out the present invention without departing from the spirit and scope thereof. Insofar as these changes and modifications are with the purview of the appended claims, they are to be considered as part of the present invention.

What is claimed:

1. A process for forming a single piece rim for vehicle wheels of the type having a radially directed flange for use in securing the rim to a wheel center, said process comprising the steps of pressing a toroid of alloy material in an axial direction between a pair of dies to cause a portion of said material to flow into one of said dies and a portion of said material to flow about the other of said dies so as to define a hollow tubular element of predetermined length having annular inwardly directed radial flange intermediary of the ends thereof and spaced predetermined distances from the ends of said element; machining said flange to define parallel surfaces perpendicularly disposed with respect to the longitudinal axis of said tubular element; and bending the ends of said element radially outwardly and axially to define an inner rim flange and an outer rim flange.

2. The process of claim 1 wherein one of said dies is stationary and defines a cylindrical recess therein terminating in a depending annular channel and the other of said dies defines a cylindrical outer wall terminating in a radially extending arcuate recess and said pressing step comprises disposing a toroid of alloy material within said recess in the stationary die and urging a portion of said other die axially into said recess and against said toroid causing said material to flow downwardly into said annular channel in said stationary die, upwardly about and adjacent said cylindrical outer wall of the moveable die and into said arcuate recess in said moveable die to define said hollow tubular element.

3. A process for forming a single piece rim for vehicle wheels of the type having a radially directed flange for use in securing the rim to a wheel center, said process comprising the steps of pressing a toroid of alloy material in an axial direction between a pair of dies to cause a portion of said material to flow into one of said dies and a portion of said material to flow about and adjacent the other of said dies so as to define a hollow tubular element having an annular, inwardly directed radial flange intermediary of the ends thereof; machining said flange to define parallel surfaces perpendicularly disposed with respect to the longitudinal axis of said tubular element; severing excess material from at least one end of said tubular element to define a predetermined overall axial length for said element and predetermined axial distances between said radial flange and each of said ends of said element; and bending the ends of said element radially outwardly and axially to define an inner rim flange and an outer rim flange.

4. A process for forming a single piece rim for vehicle wheels of the type having a radially directed flange for use in securing the rim to a wheel center, said process comprising the steps of disposing a toroid of alloy material in a recess in a first stationary die, said recess defining a depending annular channel adjacent the perimeter thereof; urging a second die of cylindrical configuration and having a radially extending arcuate recess therein axially against said toroid causing said material to flow downwardly into said annular channel in said stationary die, upwardly about and adjacent cylindrical outer wall of said second die and into said arcuate recess in said second die to define a hollow tubular element having an inwardly directed radial flange intermediary of the ends thereof; severing excess material from at least one end of said tubular element to define a predetermined overall axial length for said element and predetermined overall axial distances between said radial flange and each of said ends of said element; and bending the ends of said element radially upward and axially to define an inner rim flange and an outer rim flange.

5. The process of claim 4 including the step of machining said flange to define parallel surfaces perpendicularly disposed with respect to the longitudinal axis of said tubular element.

* * * * *